US005224879A

United States Patent [19]

Mullins et al.

[11] Patent Number: 5,224,879

[45] Date of Patent: Jul. 6, 1993

[54] ELECTRIC POWER OUTLET

[75] Inventors: Brian G. Mullins, Danbury; Ali El-Haj, Trumbull; Francis G. Marshall, Meriden, all of Conn.

[73] Assignee: Casco Products Corporation, Bridgeport, Conn.

[21] Appl. No.: 957,141

[22] Filed: Oct. 7, 1992

[51] Int. Cl.[5] ..... H01R 25/00

[52] U.S. Cl. ..... 439/651; 439/668; 439/736; 439/746

[58] Field of Search ..... 439/733-751, 439/281, 282, 283, 587, 101, 103, 105, 106, 638, 650-655, 668, 669

[56] References Cited

U.S. PATENT DOCUMENTS

| | | | |
|---|---|---|---|
| 3,299,390 | 1/1967 | Eckelkamp | 439/105 |
| 3,626,354 | 12/1971 | Banner | 439/651 |
| 4,201,431 | 5/1980 | McDonald | 439/103 |
| 4,445,741 | 5/1984 | Annoot | 439/651 |

*Primary Examiner*—David Pirlot

*Attorney, Agent, or Firm*—Mitchell D. Bittman; K. Gibner Lehmann

[57] ABSTRACT

A panel-mounted electrical power outlet receptacle for receiving a power plug to transfer current from circuitry located at the rear of the panel. The receptacle has a molded plastic body of tubular open-ended configuration, with an integral transverse wall intermediate its ends. A first double-ended metal terminal post is molded into said transverse wall and projects into both open ends of the body, the ends of the post being respectively receivable in sockets of cooperable separable fittings that are receivable in the body ends. There is a second double-ended metal terminal post in the form of a stamping, which is carried by the transverse wall of the plastic body. It also projects into both open ends of the body. The transverse body wall has an opening through which the second terminal post extends, and there is a snap locking construction on the plastic body and the second terminal post, which is activated upon insertion of the second terminal post in the wall opening.

14 Claims, 1 Drawing Sheet

ELECTRIC POWER OUTLET

STATEMENT AS TO RIGHTS TO INVENTIONS MADE UNDER FEDERALLY-SPONSORED RESEARCH AND DEVELOPMENT.

Research and development of the present invention and application have not been Federally-sponsored, and no rights are given under any Federal program.

BACKGROUND OF THE INVENTION

1. Field of the Invention

This invention relates to electrical power outlets or receptacles, and more particularly to a low-voltage panel-mounted outlet assemblage intended to receive a power plug so as to enable a circuit to be effected thereto from circuitry located at the rear of a panel.

2. Description of the Related Art Including Information Disclosed Under 37 CFR §§1.97-199

In the past various types of power outlet receptacles have been proposed and produced. In U.S. Pat. No. 4,713,017 dated Dec. 15, 1987 a low voltage outlet receptacle is disclosed, which features a waterproof or weatherproof construction having a sealing type front closure or door that can be swung open about a pivot, to reveal the socket for receiving the cooperable plug. The receptacle body has apertured mounting lugs along its top portion, by which it can be attached to a supporting structure. No provision is made for through-the-panel mounting. As can be readily seen, the socket is constituted of a number of separate parts, rendering the unit relatively expensive to manufacture and produce.

Another prior power outlet receptacle is disclosed in U.S. Pat. No. 5,131,870 dated Jul. 21, 1992. This device comprises a conventional cigar lighter socket or receptacle, in conjunction with a special separable plug that can replace the usual cigar lighter igniting unit. The separable plug is constructed to bypass the existing bimetallic detent fingers in the socket as regards the pick-up of electrical current, and instead it makes firm electrical contact with the central stud of the socket that mounts the bimetallic fingers whereby the electric current does not travel through the bimetal which is now used wholly as a detent device. This prior patented power outlet is panel mounted, since it utilizes the existing cigar lighter socket. While such construction operates in a wholly satisfactory manner, it has a multiplicity of parts or components representing appreciable cost. Moreover, it is unique in embodying the usual cigar lighter socket or receptacle, thereby restricting its application to plugs having a complementary configuration.

SUMMARY OF THE INVENTION

The above disadvantages and drawbacks of prior low-voltage electrical power outlets are obviated by the present invention, and one object of the invention is to provide an improved low voltage electrical outlet which is especially simple in its construction, involving unbelieveably few parts or components.

Another object of the invention is to provide an improved power outlet as above set forth, which is economical in construction whereby the manufacturing cost can be very low.

Still another object of the invention is to provide an improved electrical outlet as characterized above, which involves a minimum amount of labor in its fabrication, so as to further reduce labor costs.

Yet another object of the invention is to provide an improved power outlet in accordance with the foregoing, which can efficiently handle low amounts of power and is at the same time reliable in operation and not likely to malfunction or short-circuit.

A still further object of the invention is to provide an improved power outlet as above outlined, which can be easily and quickly mounted in the opening of a panel and from the front thereof, as by a simple push-in operation, and can also be readily removed therefrom in the event that this is desired.

The above objects are accomplished by the provision of a power outlet receptacle comprising a molded plastic body of generally tubular double-open-ended configuration, having an integral transverse wall that is intermediate the ends of the body, such wall supporting two double-ended metal terminal posts both of which project into the open body ends. One metal post is round at one end, with a flat blade at the other end, such post being in the form of a solid rod having a shoulder intermediate its ends and being molded in the transverse wall of the body at the time that the latter is formed or molded. The other terminal is in the form of a metal stamping having a flat blade-like configuration at one end and a bowed spring-like configuration at the other end. The metal stamping has a unique mounting in its central portion, comprising a pair of tabs and a lanced spring finger which cooperate with openings in the transverse body wall to enable an easy and quick push assembly of the terminal to the body to be effected. In such assembly, the spring terminal snaps into place and is securely retained.

Other features and advantages will hereinafter appear.

DESCRIPTION OF THE PREFERRED EMBODIMENT

Figure 6:
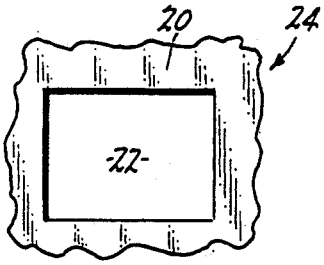
FIG. 6 is a face view of a portion of a panel, showing the rectangular opening in which the power outlet is to be received.
Figure 5:
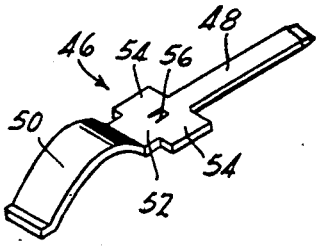
FIG. 5 is a perspective view of one of the double-ended terminal posts of the power outlet.
Figure 1:
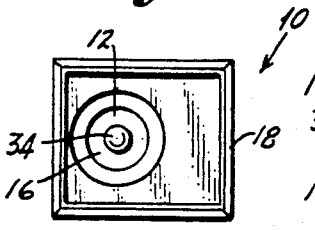
FIG. 1 is a front elevational view of the improved electrical power outlet of the invention.
Figure 2:
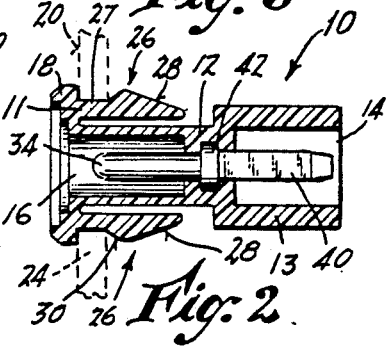
FIG. 2 is a vertical sectional view of the power outlet, through one of the terminal posts, taken on the line 2—2 of FIG. 7.

Referring now to the drawings in detail, the improved power outlet as shown comprises a molded plastic body 10 which is of generally tubular open ended configuration, the body 10 having an integral transverse wall 12 which is intermediate a pair of open ends 14 and 16. As seen in FIGS. 1, 3, 7 and 8 the body 10 is of roughly rectangular or quadrilateral shape, having a frontal mounting portion 11 and a rear, plug-receiving portion 13. The body 10 has a bezel 18 that is adapted to fit against and engage the front surface 20 of a panel 24, which surface adjoins an opening 22 in the panel, see FIGS. 2 and 6.

Figure 3:
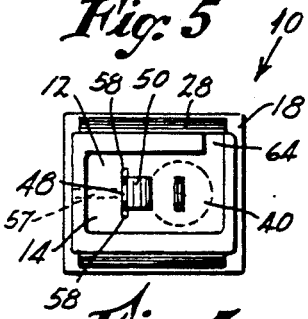
FIG. 3 is a rear plan view of the power outlet.

Simplified mounting means are provided, for securing the body 10 to the panel 24 in accordance with the invention. Such mounting means is integral with the body, being molded at the time that the body is molded and being carried by the bezel 18 as clearly seen in FIG. 2. The mounting means is in the form of two wide resilient tapered clips or fingers 26 that are substantially coextensive in width with the top and bottom sides of the bezel 18 whereby they have great strength to resist breakage even when considerable force is exerted on them. This relationship is shown in FIG. 3, for example, and the sectional view of FIG. 2 indicates the relatively thick bases 27 of the clips 26 by which the likelihood of their breaking off is minimized. The clips 26 have oppositely disposed camming surfaces 28 and 30 which are engageable with the edges of the opening 22 of the panel 24 to facilitate the insertion of the body 10 into the opening, and also to facilitate the removal of the body 10 from the panel should this be desired. The surfaces 30 are short or stubby in nature to insure against accidental slipping out of the body 10 from the panel 20, whereas the surfaces 28 are longer and more expansive or less sloping, to facilitate the easy insertion of the body 10 into the panel 24.

Between the clips 26 of the body 10 there is the cylindrical opening or bore 16 which houses a cylindrical end 34 of a first double-ended metal terminal post 36. At the other end of the body 10 the opening 14 houses the other end 40 of the terminal post 36, which other end is in the form of a flat blade. Intermediate its ends, the post 36 has an annular shoulder 42 which, with immediately adjoining portions of the terminal are embedded or molded in the transverse wall 12 of the body 10, thereby to securely anchor the terminal post in its operative position.

Figure 4:
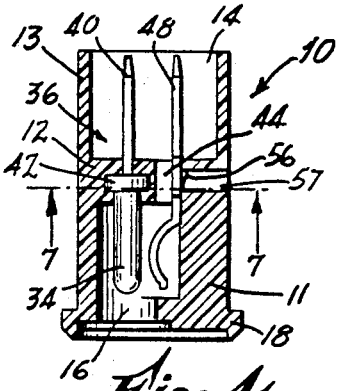
FIG. 4 is a horizontal sectional view of the body part of the outlet construction, taken on the line 4—4 of FIG. 7.
Figure 7:
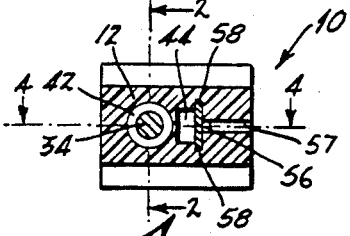
FIG. 7 is a transverse section of the body part of the outlet, taken on the line 7—7 of FIG. 4.
Figure 8:
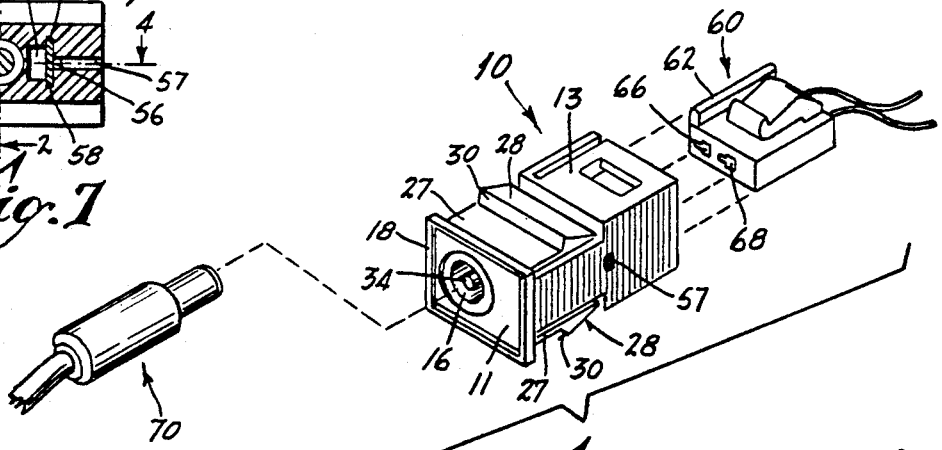
FIG. 8 is a perspective view of the power outlet and front and rear cooperable plug units adapted for use therewith.

As provided by the invention, the transverse wall 12 of the body 10 has a through opening 44 to accommodate a second double-ended metal terminal post 46 which is in the shape of a formed or stamped blade having a straight tine 48, a bowed tine 50, and an intermediate anchorage or mounting portion 52 provided with positioning tabs 54. The mounting portion 52 also has a lanced spring finger 56 which constitutes part of an automatic snap-acting locking means in cooperation with a side hole or locking slot 57 in the side wall of the body 10, such slot communicating with the opening 44 in the body wall 12. The opening 44 further has slots 58 located respectively in a pair of its opposite walls, as seen in FIG. 7. The slots 58 accommodate the tabs 54 of the terminal 46, acting as guides when the terminal is being inserted in the body 10. During such insertion through the bore 14 of the body, the spring finger 56 first becomes depressed and then snaps into the locking slot 57, for which condition the terminal 46 is properly retained and supported for functioning. As shown in FIGS. 4 and 7, the finger 56 extends part way into the hole 57 when the post 46 is seated in position.

When the power outlet is mounted in the panel 20 it is energized by means of a quadrilateral-shaped supply fitting or plug 60 that is inserted in the rear open end 14 of the body 10. Such a supply plug can be of the type known commercially by the designation "PACKARD # 1203-3709" or an equivalent, having a keying flange 62 adapted to slide into a slot 64 provided in the upper wall of the body 10, see FIGS. 3 and 8. The slot 64 is provided only in the rear portion of the body 10, which has the open end 14. The PACKARD plug identified above has one receptacle opening 66 to accommodate the flat terminal portion 40 of the power outlet, and has another receptacle opening 68 to accommodate the flat spade-like terminal portion 48 of the present improved receptacle.

The front portion of the body 10, having the open end 16 projects from the panel 20 only by the extent of the bezel 18. This end is adapted to receive a standard 5 mm. DC Power Plug 70, having a generally cylindrical configuration.

While the disclosed embodiment of the invention illustrated in FIGS. 1–8 relates to a receptacle body having a generally rectangular exterior configuration, the principles of the invention could also be applied to an outlet receptacle having a cylindrical outer body, so as to be receivable in a round panel hole.

Figure 10:
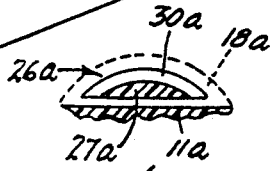
FIG. 10 is a fragmentary transverse sectional view, taken on the line 10—10 of FIG. 9.
Figure 9:
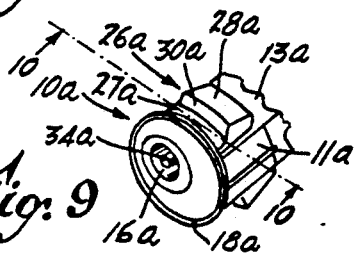
FIG. 9 is a fragmentary perspective view of another embodiment of the invention, wherein the frontal mounting portion of the outlet body is cylindrical.

Another embodiment of the invention with such a rounded frontal body portion is illustrated in FIGS. 9 and 10, wherein reference characters similar to those of FIGS. 1–8 but appended with the letter "a" have been applied. In FIG. 9 the rounded frontal portion of the body **10*a* is indicated by the numeral 11*a*, such portion merging with a quadrilateral-shaped rear body portion designated 13*a*. The body 10*a* has oppositely disposed spring clips or fingers 26*a* with rounded base portions 27*a*, and rounded camming surfaces 28*a* and 30*a*. The frontal portion 11*a* of the body 10*a* has a bore 16*a* which houses the end 34*a* of the double-ended terminal post. A bezel 18*a* on the frontal portion 11*a* engages the front of the panel on which the outlet is mounted. FIG. 10 shows the partially curvilinear nature of the bases 27*a*, which have inner flat sides and outer curved sides. Functioning of the embodiment of FIGS. 9 and 10 is similar to that already described for FIGS. 1–8**.

It will now be seen that we have provided a novel, especially simple and inexpensive power outlet receptacle which is of rugged construction having few and simple parts, and which is reliable in its functioning and capable of an extended period of useful life. Essentially the outlet comprises only the minimum necessary of separate components, namely 3 pieces: a pair of terminals and an insulating body carrying them.

The outlet receptacle is especially adapted for low power applications involving miniature plugs of the type employed on modern vehicles, such as those associated with headphone circuits (audio frequency lines), radar detectors, video games, and the like (low current +12 volt lines). In this connection, the small physical size of the present receptacle makes it especially adaptable for such low current applications.

Variations and modifications are possible without departing from the spirit of the invention.

Each and every one of the appended claims defines an aspect of the invention which is separate and distinct from all others, and accordingly it is intended that each claim be treated in this manner when examined in the light of the prior art devices in any determination of novelty or validity.

What is claimed is:

1. An electrical power outlet receptacle adapted to be mounted in a panel for receiving a power plug to enable a circuit to be effected thereto from circuitry located at the rear of the panel, comprising in combination:

a) a molded plastic body of generally tubular open-ended configuration, having an integral transverse wall intermediate two ends thereof, b) a first double-ended metal terminal post carried by and molded into said transverse wall and projecting into both said ends of the plastic body, ends of said post being respectively receivable in sockets of cooperable separable fittings that are receivable in the body ends, c) a second double-ended metal terminal post carried by said transverse wall of the plastic body and projecting into both said ends of the body, said transverse wall of the body having an opening through which the said second post extends, and d) automatic snap locking means on said body and second terminal post, activated upon insertion of the second terminal post in said wall opening to lock the second terminal post in said body.

2. A power outlet receptacle as set forth in claim 1, wherein:

a) the first metal post has an annular shoulder intermediate its ends, which is embedded in the molded plastic body to effect a secure anchorage therein.

3. A power outlet receptacle as set forth in claim 1, wherein:

a) the snap locking means comprises a resilient lanced finger carried by the second metal post, and a locking slot in the plastic molded body, into which the lanced finger extends.

4. A power outlet receptacle as set forth in claim 1, wherein:

a) the second metal post comprises a resilient metal leaf spring having a lanced angularly extending finger engageable with the molded plastic body to anchor the second post therein.

5. A power outlet receptacle as set forth in claim 4, wherein:

a) the second metal post has raised positioning tabs intermediate its ends, b) said molded plastic body having slots in which the positioning tabs of the second metal post are disposed.

6. A power outlet receptacle as set forth in claim 5, wherein:

a) the lanced angularly extending finger of the second metal post is disposed between the said raised positioning tabs.

7. A power outlet receptacle as set forth in claim 1, wherein:

a) the opening in the transverse wall of the plastic body is of generally rectangular shape, said body having a pair of oppositely disposed slots located respectively in a pair of opposite walls of the opening.

8. A power outlet receptacle as set forth in claim 7, wherein:

a) the opening in the transverse wall of the plastic body has a third wall the surface of which is flush with surfaces of said slots.

9. A power outlet receptacle as set forth in claim 1, wherein:

a) the molded plastic body has a rectangular transverse cross section and a rectangular bezel at one end, b) said body further having a pair of exterior flat oppositely disposed resilient clips adjoining said bezel and adapted to be forced through a rectangular panel opening for the purpose of mounting the plastic body on the panel.

10. A power outlet receptacle as set forth in claim 9, wherein:

a) each clip has a pair of oppositely disposed camming surfaces engageable with the edges of the opening of the panel to facilitate the insertion of the body into and removal from the panel.

11. A power outlet receptacle as set forth in claim 3, wherein:

a) the molded plastic body has a side hole communicating with said opening, b) a wall of said side hole constituting shoulder means engageable with said finger, for locking the second post in position.

12. A power outlet receptacle as set forth in claim 11, wherein:

a) said finger extends part way into said side hole.

13. A power outlet as set forth in claim 1, wherein:

a) the molded plastic body has a rear portion of rectangular transverse cross section, a frontal portion of substantially cylindrical configuration, and a circular bezel at the front of the frontal portion, b) said body further having a pair of exterior oppositely-disposed resilient clips adjoining said bezel and adapted to be forced through a circular panel opening for the purpose of mounting the plastic body on the panel.

14. A power outlet receptacle as set forth in claim 13, wherein:

a) said resilient clips have flat inner sides and curved outer sides measured transversely of the axis of the body.

* * * * *